United States Patent [19]

Young

[11] Patent Number: 4,490,119

[45] Date of Patent: Dec. 25, 1984

[54] BOAT PROPULSION APPARATUS

[76] Inventor: Ronald G. Young, 2698 Camcrest Dr., Nanaimo, B.C., Canada, V9T 4W4

[21] Appl. No.: 476,984

[22] Filed: Mar. 21, 1983

[51] Int. Cl.[3] ..... B63H 1/36

[52] U.S. Cl. ..... 440/14; 440/13; 440/20; 416/83

[58] Field of Search ..... 440/13, 14, 15, 16, 440/17, 18, 19, 20; 416/79, 82, 83

[56] References Cited

U.S. PATENT DOCUMENTS

| | | | |
|---|---|---|---|
| 35,451 | 6/1862 | Johnson | 416/81 |
| 659,858 | 10/1900 | Palmer | 440/14 |
| 706,198 | 8/1902 | Phares | 440/13 |
| 1,068,665 | 7/1913 | Juberg | 440/13 |
| 1,116,117 | 11/1914 | Pullen | 440/13 |
| 1,130,153 | 3/1915 | Dennis | 440/14 |
| 1,937,907 | 12/1933 | Nock | 440/14 |
| 3,508,840 | 4/1970 | Lederlin | 416/79 |

FOREIGN PATENT DOCUMENTS

| | | | |
|---|---|---|---|
| 1650772 | 3/1978 | Fed. Rep. of Germany | 416/83 |
| 658899 | 6/1929 | France | 440/14 |

*Primary Examiner*—Galen L. Barefoot
*Assistant Examiner*—Patrick W. Young
*Attorney, Agent, or Firm*—Vernon J. Pillote

[57] ABSTRACT

A boat propulsion apparatus having a thrust blade mounted for swinging movement about a generally horizontal axis lengthwise of the boat and for turning movement about an upright axis, and a swash plate drive for simultaneously swinging the blade in a direction crosswise of the boat and for angularly oscillating the blade about its upright axis to sinusoidally vary the pitch of the blade as the blade is swung crosswise of the boat. Provision is made for reversing the direction of angular oscillation of the blade about the upright blade axis relative to the direction of the swinging movement of the blade to enable forward and reverse drive. A variable angle swash plate drive is provided to vary the mechanical advantage of the drive.

21 Claims, 15 Drawing Figures

VIEW 8A

BOAT PROPULSION APPARATUS

BACKGROUND OF THE INVENTION

Although rotary propellers are by far the most common propulsion systems used in power boats, rotary propellers do present a number of problems and have a number of disadvantages. Generally, only 35 to 50 percent of the power applied to the propeller goes into boat motion, with the rest being lost to friction, wake-forming and hub and tip vortices. Only the propeller blade contributes to thrust, and then through only a portion of each revolution of the blade, and the other underwater portions of the propeller propulsion system including propeller hub, propeller shaft, and shaft support legs, only cause drag. Rotary propellers also produce a torque reaction which adversely affects the trim and steering of the boat. In addition, rotary propellers require a critical dynamic balance which is expensive to obtain and maintain; are subject to cavitation; are easily fouled by ropes, seaweed and the like, and are subject to electrolytic corrosion because of their proximity with other underwater metal parts such as the shaft, shaft bearing, etc. of different metal composition. Further, rotary propellers require expensive reverse gearing to enable reversing of the propeller drive and the rotary propellers are even less efficient when operated in reverse because of underwater structures that are in the path of the high velocity reverse flow from the propeller.

Boat propulsion apparatus have also been proposed for example as shown in U.S. Pat. Nos. 35,451; 659,858 and 1,937,907, in which an upright propelling blade is supported for swinging movement about a vertical axis on the rear end of support arms, the forward ends of which support arms are mounted on a boat for swinging movement about an upright axis so that the blade is moved with a generally fish tail type motion at the rear of the boat. In U.S. Pat. Nos. 35,451 and 1,937,907 a power operated mechanism is provided for swinging the support arms about the upright axis and the blades are supported for free swinging movement at the rear ends of the arms between angularly spaced blade stops. Such devices do not have any positive control of the blade with angle throughout the cycle of operation. In U.S. Pat. No. 659,858, a drive is provided that extends through the support arms to the blades for swinging the blades about an upright axis relative to the rear ends of the control arms in timed relation with the swinging of the control arms about an upright axis adjacent their forward ends. The blade drive mechanism in this patent must extend through the horizontally swingable arms and is therefore relatively complex and expensive to produce and maintain. In addition, the horizontally swinging arms of this patent do not contribute to the forward thrust of the propulsion apparatus and they must be relatively large to house the blade drive mechanism so that the arms provide relatively large underwater surfaces that increase drag and reduce hydrodynamic efficiency.

SUMMARY OF THE INVENTION

The general object of this invention is to provide a boat propulsion apparatus which is more efficient and hence more economical to operate than prior boat propulsion apparatus.

Another object of this invention is to provide a boat propulsion apparatus which can be easily reversed at operating power levels and which operates as efficiently in reverse as in forward motion.

Another object of this invention is to provide a boat propulsion apparatus which can be selectively adjusted to provide an infinitely variable mechanical advantage to the thrust blades to suit all loads and speeds.

Still another object of this invention is to provide a boat propulsion apparatus which eliminates all underwater drag creating parts except the actual thrust producing member to thereby minimize turbulence, reduce the tendency to become fouled by ropes, seaweed and the like, and to present only a single metal to the water to minimize electrolytic corrosion.

Accordingly, the present invention provides a boat propulsion apparatus comprising a support structure, at least one swing frame mounted on the support structure for swinging movement relative thereto about a swing axis arranged to extend generally lengthwise of the boat, at least one thrust blade and means mounting the thrust blade on the swing frame for swinging movement therewith about the swing axis and for turning movement relative to the swing frame about a generally upright blade axis, the thrust blade extending downwardly from the swing frame and having thrust surfaces at opposite sides, drive means for angularly oscillating the swing frame about the swing axis to swing the thrust blade in a direction crosswise of the boat, the drive means including means for angularly oscillating the thrust blade about the generally upright blade axis in timed relation with the angular oscillation of the swing frame.

The drive means advantageously includes direction control means for selectively reversing the direction of angular oscillation of the thrust blade relative to the direction of angular oscillation of the swing frame, to reverse the direction of propulsion.

The propulsion apparatus also advantageously includes thrust control means for selectively varying the amplitude of angular oscillation of the swing frame in a direction crosswise of the boat, and the amplitude of angular oscillation of the thrust blade about the general upright blade axis, to vary the mechanical advantage of the thrust blade to suit varying loads and speeds.

These, together with other objects, features and advantages of this invention will be more readily understood by reference to the following detailed description, when taken in connection with the accompanying drawings wherein:

FIG. 8A is a side view of the swash plate adjusting screw and coupling member;

Figure 1:
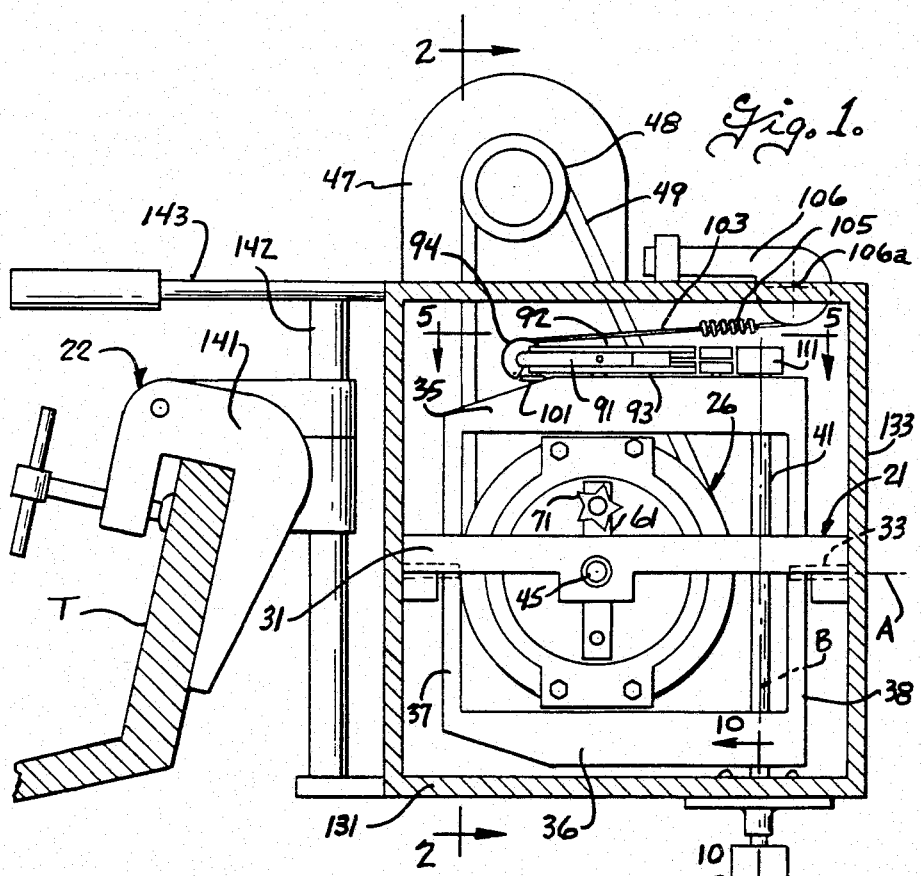
FIG. 1 is a longitudinal vertical sectional view through the boat propulsion apparatus taken on the plane 1—1 of FIG. 2 and showing the apparatus mounted on the transom of a boat.
Figure 14:
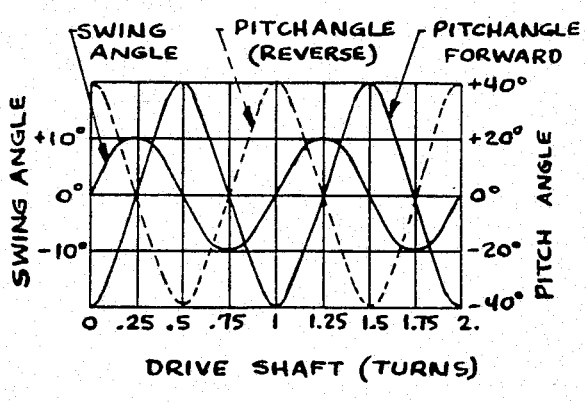
FIG. 14 is a graph illustrating the blade swing angle and the blade pitch angle in forward and reverse, at different angular positions of the drive shaft.

The boat propulsion apparatus of the present invention is adapted for use on various different types of boats and may, for example, be arranged for mounting on the transom of a boat outboard of the hull for operation as an outboard propulsion apparatus. Alternatively, the boat propulsion apparatus can be mounted inside the hull with only the thrust blades extending externally of the hull, for operation as an inboard propulsion apparatus. The Propulsion apparatus can be the sole means for propelling the boat or, alternatively, can provide an auxiliary power system for sail boats and the like.

The boat propulsion apparatus in general includes a support structure 21, a means 22 for mounting the support structure on a boat, at least one and preferably an even number of swing frames designated 23 mounted on the support structure for swinging movement about a generally horizontal swing axis A extending parallel to the length of the boat, at least one thrust blade 25 mounted on each swing frame for swinging movement therewith about the swing axis and for turning movement relative to the associated swing frame about a generally upright blade axis B. The thrust blade extends downwardly from the swing frame and has thrust surfaces 25*a* and 25*b* at relatively opposite sides. A drive mechanism 26 is provided for angularly oscillating the swing frames about their swing axis A to swing the associated thrust blades in a direction crosswise of the boat, and for simultaneously angularly oscillating the thrust blades about their generally upright blade axis B in timed relation with the angular oscillation of the swing frame.

In the embodiment shown, the support structure 21 includes a support frame having outer and intermediate support frame members 31 and 32 extending generally lengthwise of the boat and cross support frame members 33 extending crosswise of the boat and rigidly interconnecting the outer and intermediate frame members. The swing frames 23 each include upper and lower swing frame members 35 and 36 which are interconnected by forward and rear swing frame members 37 and 38, and the swing frames are pivotally mounted by pins 39 that extend into suitable bearings on the cross frame members 33 for swinging movement about the swing axis A extending lengthwise of the boat. The thrust blades 25 each have a shaft 41 extending lengthwise from its upper end and which shaft is rotatably supported in suitable bearings on the upper and lower frame members 35 and 36 of a respective one of the swing frames for rotation about the generally upright blade axis B. Thus, the blades 25 are supported on the swing frame for swinging movement therewith about the swing axis A in a direction crosswise of the boat, and also for turning movement relative to the associate swing frame about an upright blade axis B.

Figure 7:
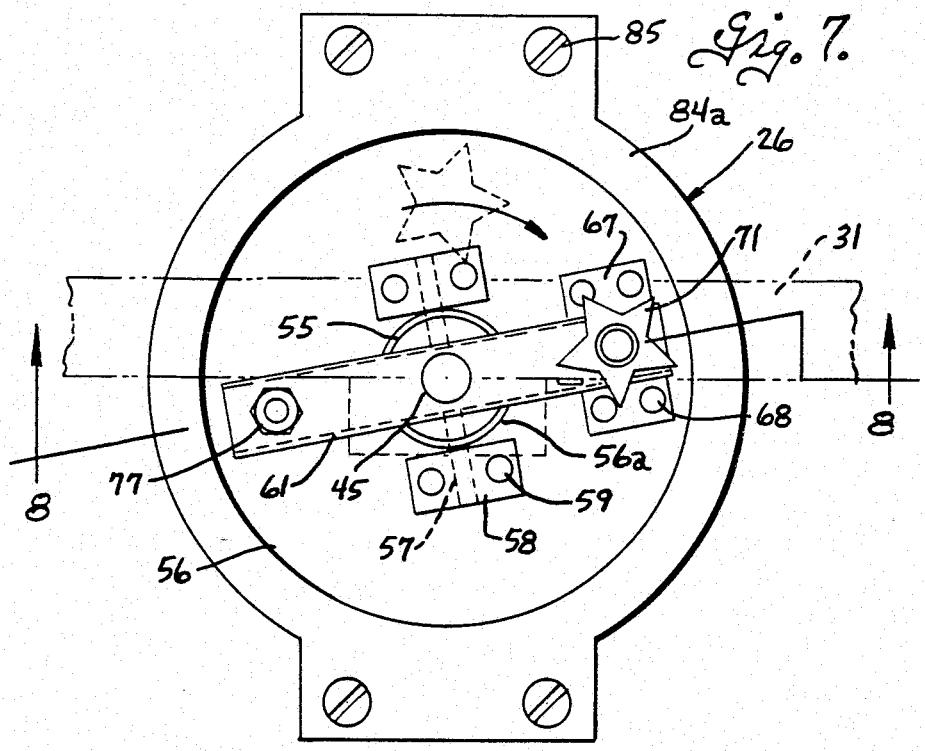
FIG. 7 is a fragmentary vertical sectional view taken on the plane 7—7 of FIG. 2, but with the drive assembly rotated clockwise from the position shown in FIG. 2.
Figure 8:
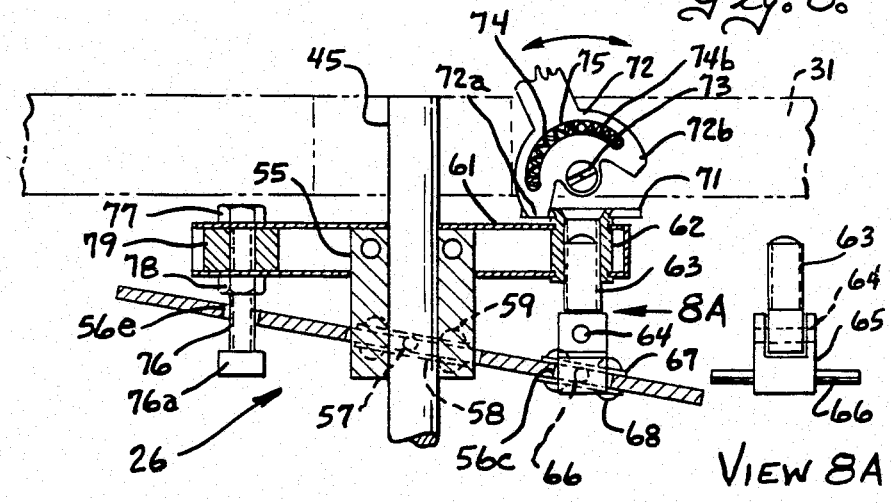
FIG. 8 is a fragmentary sectional view taken on the plane 8—8 of FIG. 7.
Figure 9:
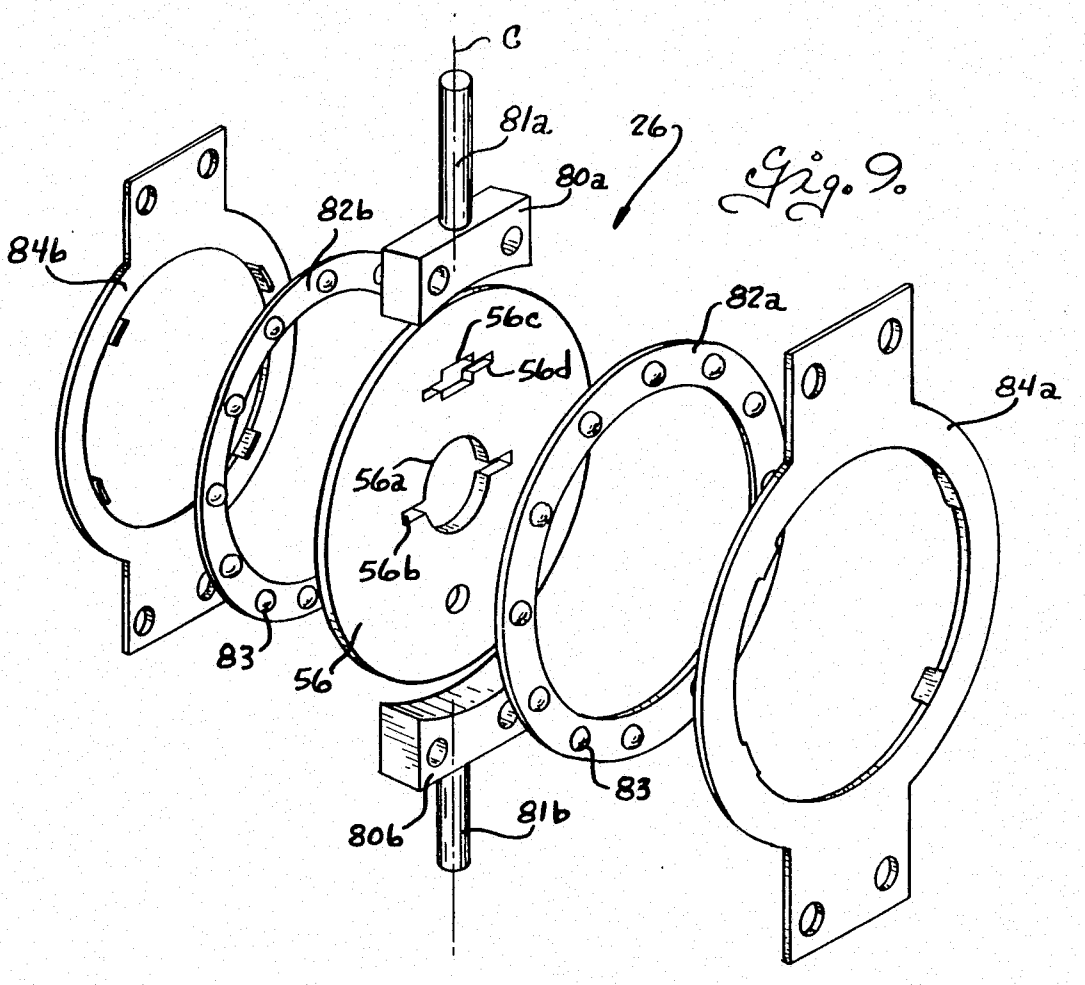
FIG. 9 is an exploded perspective view of the swash plate and swash plate follower.

The drive mechanism 26 includes a generally horizontal drive shaft 45 that extends crosswise of the boat and which is supported for axial rotation in suitable bearings on the outer and intermediate support frame members 31 and 32. The drive shaft 45 is conveniently formed in two endwise aligned sections that are interconnected at their adjacent ends as by a spline coupling 45*a*, and the drive shaft is driven from a drive motor 47 through drive pulley 48, belt 49 and driven pulley 51 that is non-rotatably connected as by a set screw to the drive shaft 45. A swash plate drive is provided for oscillating each of the swing frames and the thrust blade associated therewith. In the preferred embodiment illustrated, provision is made for adjusting the angle of the swash plate relative to the shaft 45. Each swash plate drive includes a hub 55 that is non-rotatably connected to the drive shaft 45, and a swash plate 56 that is pivotally mounted on the hub 55 for movement about an axis extending generally radially of the drive shaft 45. As best shown in FIGS. 7–9, the swash plate 56 has a central opening 56*a* dimensioned to loosely surround the hub and radially extending notches 56*b* that intersect the opening 56*a*. Drive pins 57 (FIGS. 7 and 8) are mounted on the hub 55 and extend in diametrically opposite directions into the notches 56*b* of the drive plate, and the pins are rotatably clamped in the notches 56*b* by retainer plates 58 secured by fasteners 59 to opposite sides of the swash plate. The drive pins 57 rotate the swash plate with the drive shaft, but allow the swash plate to tilt angularly relative to the shaft into and out of a position extending perpendicular to the shaft. A drive arm 61 is fixedly secured to the hub 55 for rotation therewith and an internally threaded nut 62 (FIG. 8) is mounted on the arm at a location spaced outwardly from the shaft 45, for rotation about an axis parallel to the shaft. A jack screw 63 is threaded into the nut 62 and is pivotally connected at one end by a pin 64 to a coupling link 65. The coupling link has laterally extending pins 66 paralleling the pin 64, and the swash plate 56 has an opening 56*c* for loosely receiving the coupling link 65 and laterally extending notches 56*d* that intersect the opening 56*c* and which receive the pins 66. Retainer plates 67 are clamped to opposite sides of the swash plate across the notches 56*d* by fasteners 68, to connect the coupling member to the swash plate for relative pivotal movement about the axis of the pins 66.

The arm 61 rotates with the hub 55 to drive the swash plate and provision is made for angularly adjusting the swash plate during and in response to rotation of the swash plate. As best shown in FIGS. 7 and 8, a star wheel 71 is non-rotatably secured to one end of the nut 62 and a trigger member 72 is pivotally mounted by a pivot pin 73 on one of the outer members 31 of the support structure. The trigger has nose portions 72*a* and 72*b* that can be selectively moved by pivoting of the trigger into the path of movement of the star wheel at locations respectively radially inwardly and radially outwardly of the axis of the nut 62, to engage the star wheel and index the nut in one direction or the other, each time the star wheel moves past the trigger. Springs 74*a* and 74*b* are disposed in an arcuate slot in the trigger and engage a pin 75 on the frame member 31, to normally bias the trigger to a mid or neutral position in which both of the nose portions 72*a* and 72*b* are disposed out of the path of movement of the star wheel. A limit stop 76 is mounted as by nuts 77 and 78 on the arm 61 at the side opposite the nut 62, and the stop 76 extends through an opening 56*e* in the swash plate and has a head 76*a* at its outer end arranged to engage the swash plate when the swash plate is disposed generally perpendicular to a shaft 45. One of the nuts 78 engages the swash plate when the latter reaches a preselected angle, for example ten degrees relative to the shaft, to limit the maximum angle of adjustment to the swash plate. A weight 79 is provided on the arm 61 at the end remote from the nut 62 and is selected to balance the whole swash plate and drive arm assembly.

Swash plate followers comprise upper and lower follower members 80*a* and 80*b* having pintles 81*a* and 81*b* that are rotatably supported in suitable bearings in the upper and lower members 35 and 36 of the associated swing frame 23, for turning about a generally upright axis C extending radially of the drive shaft 45. Annular ball retainer rings 82*a* and 82*b* are each having a plurality of circumferentially spaced roller balls 83 are disposed at opposite sides of the swash plate 56 and are clamped between annular retainer plates 84*a* and 84*b* that are secured by fasteners 85 to the upper and lower follower members 80*a* and 80*b*. As shown in FIG. 9, lugs are provided on the retainer plates to extend inside the annular ball retainers 82 to radially locate the same. Thus, when the swash plate 56 is disposed at an angle to the drive shaft 45 and the drive shaft is rotated, the swash plate imparts a swinging motion to the swing frames 23 about the swing axis A, and it also imparts an angular oscillating motion to the follower members 80*a* and 80*b* about the axis C of the pintles 81*a* and 81*b*.

Figure 4:
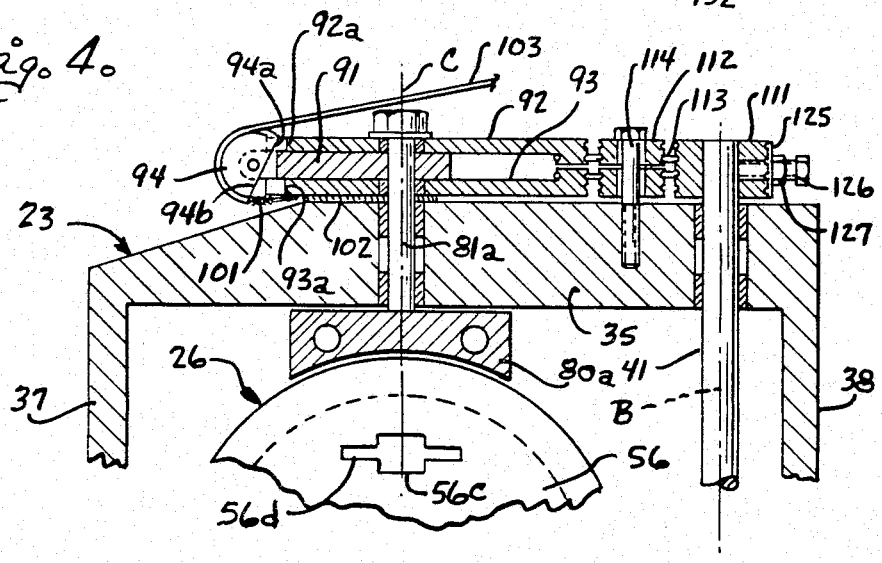
FIG. 4 is a fragmentary vertical sectional view taken on the plane 4—4 of FIG. 2 and illustrating parts on a larger scale.
Figure 5:
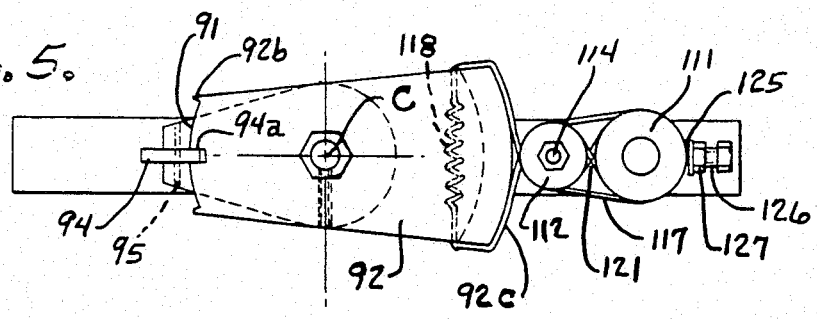
FIG. 5 is a fragmentary horizontal sectional view taken on the plane 5—5 of FIG. 1 and illustrating the forward-reverse mechanism on a larger scale.
Figure 6:
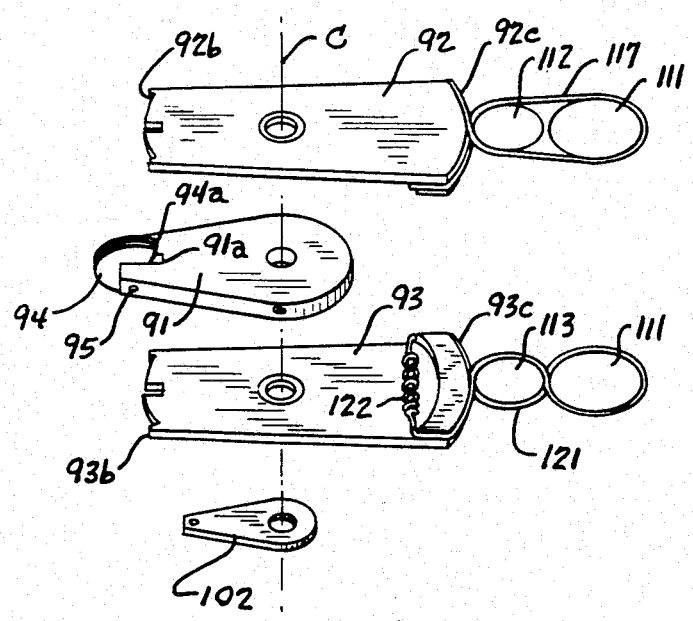
FIG. 6 is an exploded perspective view of the forward-reverse mechanism.

The upper follower 80*a* is connected to the associated thrust blade to oscillate the thrust blade in response to the angular oscillation of the follower. The connecting means advantageously includes a motion amplifying means to increase the angular motion of the thrust blade relative to the angular motion of the follower. In addition, the connecting means advantageously includes means for reversing the direction of rotation of the thrust blade relative to the direction of angular oscillation of the follower to enable the boat propulsion apparatus to be used for both forward and reverse drive. As best shown in FIGS. 4–6, a drive member 91 is non-rotatably connected as by a set screw to the pintle 81*a* on the upper follower member 80*a* for turning movement with the upper follower member. Forward and reverse drive segments 92 and 93 are mounted on the upper pintle 81*a* for turning relative thereto and relative to the drive member 91, and a clutch member 94 is provided for selectively connecting the drive member 91 to either the forward drive segment 92 or reverse drive segment 93, to drive the latter with the drive member. The clutch member 94 is disposed in a slot 91*a* in the drive member 91 and is pivotally supported thereon by a pin 95 for pivotal movement in an upright plane relative to the drive member. The clutch member 94 has nose portions 94*a* and 94*b* respectively adapted to cooperate with slots 92*a* and 93*a* in the upper and lower drive segments. The clutch member can be moved from a neutral position out of engagement with the forward and reverse drive segments, selectably to a forward position as shown in FIG. 4 in which the upper nose portion 94*a* extends into the notch 92*a* in the forward drive segment, to a reverse position in which the lower nose 94*b* extends into the notch 93*a* in the reverse drive segment 93. As best shown in FIGS. 1 and 4, the clutch 94 is yieldably biased by a spring 101 attached to a spring anchor 102 that can swing about the pintle 81*a*. in a direction to move the nose portion 94*b* into the notch 93*a* in the reverse drive segment 93. A control line 103 is connected to the clutch member 94 and through an overload spring 105 (FIG. 1) to a clutch operating member 106. The clutch operating lever is pivotally mounted at 106*a* and, when the clutch operating lever is moved to its lower position shown in FIG. 1, it applies tension through spring 105 to the cable 103. Spring 105 is sufficiently stronger than the spring 101 to bias the clutch 94 in a direction to engage the forward drive segment. When the clutch operating lever 106 is moved to a raised position, it releases tension on the operating cable 103 so that the spring 101 can move the clutch into engagement with reverse drive segment. The operating lever can also be moved to an intermediate position in which the clutch does not engage either the forward or reverse drive segments. Stops 92*b* and 93*b* are provided on the forward and reverse drive segments to prevent the drive member 91 from carrying the clutch member 94 past the drive segments, when the clutch is disengaged.

Figure 12:
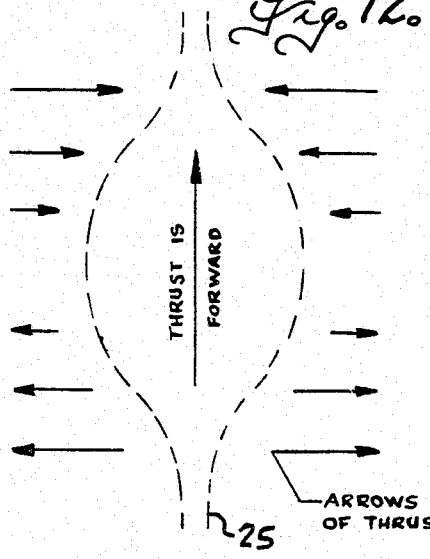
FIG. 12 is a diagrammatic plan view relating the changes in pitch angle of a pair of oppositely phased thrust blades to the crosswise swing of the thrust blades when in the forward drive mode.
Figure 13:
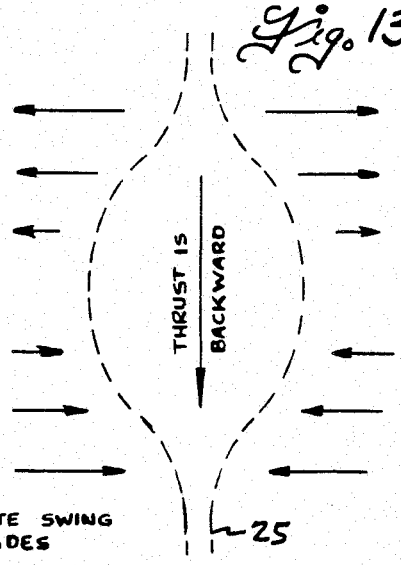
FIG. 13 is a diagrammatic plan view relating the change in pitch angle of a pair of oppositely phased thrust blades to the lateral swing of the thrust blades when in the reverse drive mode.

A grooved pulley 111 is attached to the upper end of the shaft 41 of the thrust blade, and a pair of idler pulleys 112 and 113 are rotatably mounted on a pin 114 at the top of the swing frame at a location intermediate the drive segments and the pulley 111. The drive segments 92 and 93 have arcuate faces 92*c* and 93*c* respectively that are provided with upper and lower lengthwise extending grooves. An upper flexible belt or cable 117 is looped around the blade pulley 111 and idler pulley 112 and then crosses at a location intermediate the idler 112 and the forward drive segment 92 to extend in opposite direction across the grooved face 92*c* of the forward drive segment, with the ends of the cable 117 resiliently interconnected by spring 118 to maintain the cable under tension. A second cable 121 is looped around the blade pulley 111 and then crosses once at a location intermediate the blade pulley 111 and the idler pulley 113, and then recrosses at a location intermediate the idler pulley 113 and the reverse drive segment 93 to extend across the grooved face 93*c* of the reverse drive segment, with the ends of the cable 121 being interconnected by a spring 122 to maintain the cable under tension. The blade pulley 111 has a pair of vertically spaced upper grooves for receiving the cable 117 and the cable is passed from one groove to the other at a location adjacent a cable clamp 125 to prevent the cables from rubbing against each other at the point where they cross adjacent the forward drive segment 92. Similarly, the blade pulley 111 has a pair of vertically spaced lower grooves and the cable 121 is passed from one groove to the other adjacent the cable clamp 125 so that the runs of the cable 121 doe not rub at the locations where they cross each other. The pulley 111 is non-rotatably connected to the blade shaft 41 by a cap screw 126 and a nut 127 is provided on the cap screw to draw the cable clamp 125 tightly against the pulley 111. With this arrangement, the thrust blade will be angularly oscillated about the blade axis B in one phase relation to the angular oscillation of the drive member 91 when the drive member is connected to the forward drive segment 92, and the thrust blade will be angularly oscillated about the blade axis B in a second phase relation to the angular oscillation of the drive member when the drive member is connected to the reverse drive segment 93, which second phase relation is 180° out of phase with the first-mentioned phase relation. This enables the propulsion apparatus to be used to drive the boat in both a forward and reverse direction. The angular oscillation of the thrust blade about the blade axis is preferably made substantially greater than the angular oscillation of the follower 80*a*. As shown in FIG. 5, the drive segments 92 and 93 have a radius from their axis C to the arcuate surfaces 92*c* and 93*c* respectively which is approximately four times the radius of the blade pulley 111. With this arrangement, the blade is rotated about its axis through an angle about four times the degree of angular oscillation of the follower 80*a*. The turning of the thrust blades about their blade axis B must be correlated with the swinging movement of the swing frames about the swing axis A so that the medial plane of the thrust blade parallels the lengthwise dimension of the boat at both extremities of the lateral swing of the thrust blades, and the thrust blades are at the maximum angle of rotation at the center of their swing. The propulsion apparatus preferably utilizes an even number of thrust blades, herein shown two in number, and the swash plate drives for the pair of thrust blades are operated when 180° out of phase with each other. Thus, the thrust blades in each pair move in relatively opposite directions crosswise of the boat and also turn in relatively opposite directions about their blade axis B, as diagramatically shown in FIGS. 12 and 13. With this arrangement, the components of thrust in a direction crosswise of the boat are effectively cancelled out and the components of thrust in a direction lengthwise of the boat are in the same direction and are additive. The angle of swing of the blades about the swing axis A and angle of oscillation of the blades about their blade axis B can be adjusted by the trigger 72 to vary the mechanical advantage of the drive and, when the swash plate angle is adjusted to 0° the drive is in a neutral or no-drive mode.

Figure 10:
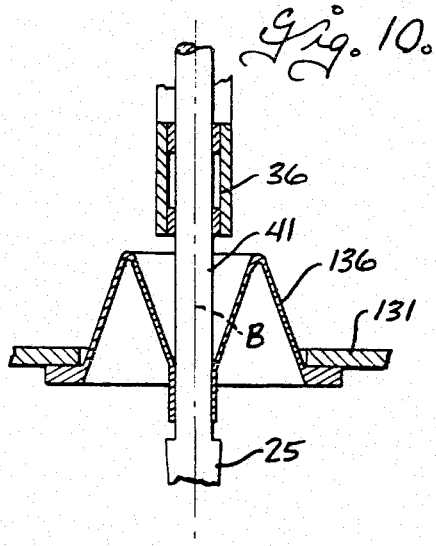
FIGS. 10 and 11 are fragmentary vertical sectional views taken on the plane 10—10 of FIG. 1, illustrating a thrust blade-to-housing seal in different moved positions.
Figure 11:
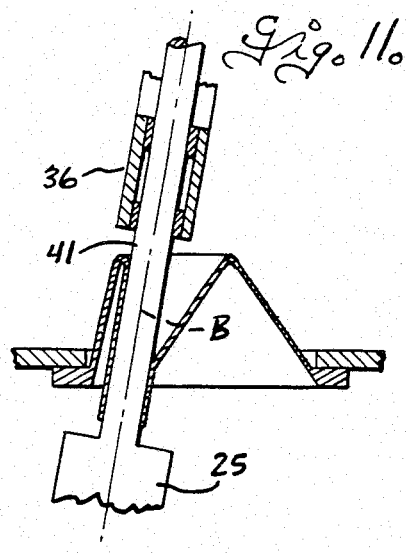

The operating mechanism of the propulsion apparatus is enclosed in a suitable enclosure designed to exclude heavy splash water or momentary submersion and, as shown, includes a bottom wall 131, side and end walls 132 and 133 and a top wall 134. The shafts 41 of the thrust blades extend downwardly through openings in the bottom wall and, as shown in FIGS. 10 and 11, a bellows type seal 136 made of a flexible material such as rubber is used to seal the interface between the shaft and the housing. The seal is arranged to allow the blade shaft to angularly rotate as well as swing from side to side as required. Any other type of suitable seal such as a sliding leaf labyrinth type may be employed, if desired.

Figure 2:
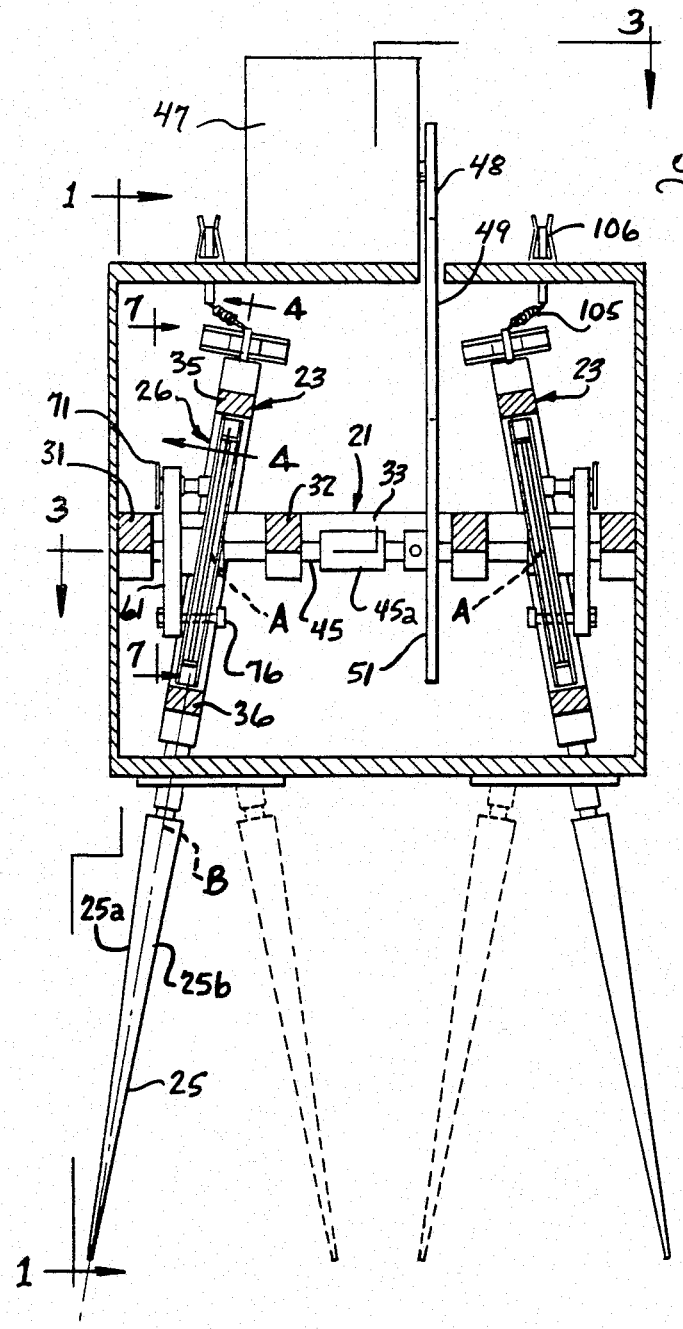
FIG. 2 is a transverse vertical sectional view taken on the plane 2—2 of FIG. 1.
Figure 3:
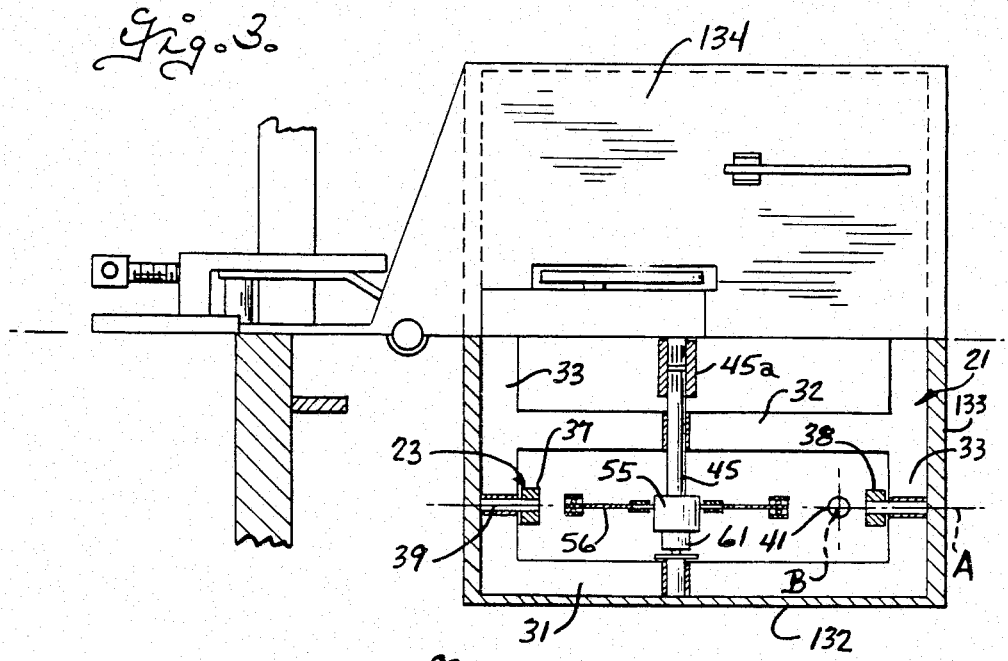
FIG. 3 is a fragmentary horizontal sectional view taken on the broken section line 3—3 of FIG. 2.

In the embodiment illustrated, the boat propulsion apparatus is arranged to be mounted on the transom T of a boat by conventional transom clamp 141 so that it can be swung about a column 142 by a tiller handle 143 or other conventional remote control, for steering purposes. Alternatively, the boat propulsion apparatus could be mounted entirely within the boat hull with only the thrust blades projecting from the bottom. The boat propulsion apparatus could, for example, be utilized as an auxiliary power source for a sail boat and, with the thrust blades arranged at maximum angle of straddle as shown in solid lines in FIG. 2, the thrust blades would act as efficient centerboards for the sail boat.

In the embodiment illustrated, the controls for each thrust blade are independent so that one thrust blade can be reversed independently of the other to enable turning of the boat in a very small circle. Alternatively, these controls can be coupled together or arranged in any other suitable manner for remote control. The thrust changing controls for the several swash plates can also be operated independently if desired to vary the amount of thrust exerted by one or the other of the thrust blades, for example to gradually change the direction of the boat. Alternatively, the controls for the several swash plates can be interconnected for simultaneous operation if desired.

The embodiments of the invention in which an exclusive property or privilege is claimed are defined as follows:

1. A boat propulsion apparatus comprising a support structure, means for mounting the support structure on a boat, at least one swing frame mounted on the support structure for swinging movement relative thereto about a generally horizontal swing axis arranged to extend generally lengthwise of the boat, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides of a blade plane extending lengthwise of the blade axis medially between the thrust surfaces, rotary drive means for angularly oscillating said swing frame about said swing axis to swing the thrust blade in a direction crosswise of the boat through a blade swing angle, said rotary drive means including means for angularly oscillating said thrust blade about the generally upright blade axis in timed relation with the angular oscillation of the swing frame to cyclically change the thrust angle of the blade between a zero thrust angle in which the blade plane is disposed parallel to the swing axis and a maximum thrust angle in which the blade plane is disposed at a preselected maximum angle to the swing axis, said rotary drive means being operative to turn the blade about the blade axis while swinging the blade about the swing axis such that the blade plane is at the maximum thrust angle when the blade is at the center of the blade swing angle and at zero thrust angle when the blade is at either extremity of the blade swing angle.

2. A boat propulsion apparatus according to claim 1 wherein said drive means includes direction control means for selectively reversing the direction of angular oscillation of the thrust blade relative to the direction of angular oscillation of the swing frame.

3. A boat propulsion apparatus according to claim 1 wherein said drive means includes thrust control means for selectively varying the amplitude of angular oscillation of the swing frame about the swing axis and the amplitude of angular oscillation of the thrust blade about the blade axis and such that the amplitude of angular oscillation of the blade about the blade axis is increased and decreased as the amplitude of oscillation of the swing frame about the swing axis is respectively increased and decreased, the thrust control means being operative to change the amplitude of angular oscillation of the blade about the blade axis to zero when the amplitude of angular oscillation of the swing frame about the swing axis is changed to zero.

4. A boat propulsion apparatus comprising a support structure, means for mounting the support structure on a boat, at least one swing frame mounted on the support structure for swinging movement relative thereto about a swing axis arranged to extend generally lengthwise of the boat, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat, said drive means including means for angularly oscillating said thrust blade about the generally upright blade axis in timed relation with the angular oscillation of the swing frame, said drive means including a drive shaft mounted on the support structure for rotation about a generally horizontal axis and a swash plate connected to said drive shaft for rotation thereby, swash plate follower means mounted on the swing frame for turning about a follower axis generally radially of the axis of said drive shaft, said swash plate follower means engaging said swash plate for movement thereby in a direction crosswise of the boat and for angular oscillation relative to the swing frame about said follower axis, and means connecting said swash plate follower means to the thrust blade for oscillating said thrust blade in response to angular oscillation of said follower means.

5. A boat propulsion apparatus according to claim 4 wherein said means for connecting the follower means to the thrust blade includes direction reversing means for reversing the direction of angular oscillation of the blade in relation to the direction of angular oscillation of the follower means.

6. A boat propulsion apparatus according to claim 5 wherein said drive means includes means for varying the angle of the swash plate relative to the axis of the drive shaft to simultaneously change the angle of oscillation of the swing frame and angle of oscillation of the thrust blade.

7. A boat propulsion apparatus according to claim 4 wherein said drive means includes means for varying the angle of the swash plate relative to the axis of the drive shaft to simultaneously change the angle of oscillation of the swing frame and angle of oscillation of the thrust blade.

8. A boat propulsion apparatus according to claim 4 wherein said drive means includes means operative during rotation of said swash plate for varying the angle of the swash plate relative to the axis of the drive shaft to change the angle of oscillation of the swing frame and thrust blade.

9. A boat propulsion apparatus comprising a support structure, means for mounting the support structure on a boat, at least one swing frame mounted on the support structure for swinging movement relative thereto about a swing axis arranged to extend generally lengthwise of the boat, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat, said drive means including means for angularly oscillating said thrust blade about the generally upright blade axis in timed relation with the angular oscillation of the swing frame, said drive means including a drive shaft mounted on the support structure for rotation about a generally horizontal axis crosswise of the boat, a hub non-rotatably secured to the drive shaft for rotation therewith, a swash plate, means mounting the swash plate on the hub for rotation therewith and for pivotal movement relative thereto about an axis radially of the drive shaft, an arm fixed to the hub and extending outwardly from the drive shaft, adjustable means including a nut and screw interconnecting said arm and said swash plate at a location outwardly of the drive shaft to adjust the angle of the swash plate in response to relative turning of said nut and screw, and control means selectively operable to cause relative rotation of said nut and screw in a first direction to increase the angle of the swash plate or in a second direction to decrease the angle of the swash plate.

10. A boat propulsion apparatus according to claim 9 wherein said control means includes a star wheel on one of the items comprising the nut and screw, and means selectively movable to a position to engage the star wheel as the drive shaft rotates at a location either radially inwardly or radially outwardly of the axis of the star wheel.

11. A boat propulsion apparatus comprising a support structure, means for mounting the support structure on a boat, at least one swing frame mounted on the support structure for swinging movement relative thereto about a swing axis arranged to extend generally lengthwise of the boat, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat, said drive means including means for angularly oscillating said thrust blade about the generally upright blade axis in timed relation with the angular oscillation of the swing frame, said drive means including a drive shaft mounted on the support structure for rotation about a generally horizontal axis crosswise of the boat, a swash plate connected to the drive shaft for rotation thereby, and swash plate follower means including a pair of follower members mounted on the swing frame for turning relative thereto about generally vertical axes extending radially of the drive shaft.

12. A boat propulsion apparatus according to claim 11 wherein said swash plate follower means includes an annular recirculating ball race at each side of the swash plate and an annular ball race retainer at the outer side of each annular ball race, and means connecting the ball race retainers to the follower members.

13. A boat propulsion apparatus comprising a support structure, means for mounting the support structure on a boat, at least one swing frame mounted on the support structure for swinging movement relative thereto about a swing axis arranged to extend generally lengthwise of the boat, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat, said drive means including means for angularly oscillating said thrust blade about the generally upright blade axis in timed relation with the angular oscillation of the swing frame, said drive means including a drive shaft mounted on the support structure for rotation about a generally horizontal axis crosswise of the boat, a swash plate connected to the drive shaft for rotation thereby, swash plate follower means mounted on the swing frame for turning about a generally upright follower axis extending radially of the drive shaft, said swash plate follower means engaging said swash plate for movement thereby in a direction crosswise of the boat and for angular oscillation relative to the swing frame about the follower axis, a drive member connected to the follower member for angular oscillation therewith, means including angular motion amplifying means for connecting the drive member to the thrust blade for oscillating the thrust blade through an angle greater than the angle of oscillation of the follower means.

14. A boat propulsion apparatus comprising a support structure, means for mounting the support structure on a boat, at least one swing frame mounted on the support structure for swinging movement relative thereto about a swing axis arranged to extend generally lengthwise of the boat, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat, said drive means including means for angularly oscillating said thrust blade about the generally upright blade axis in timed relation with the angular oscillation of the swing frame, said drive means including a drive shaft mounted on the support structure for rotation about a generally horizontal axis crosswise of the boat, a swash plate connected to the drive shaft for rotation thereby, swash plate follower means mounted on the swing frame for turning about a generally upright follower axis extending radially of the drive shaft, said swash plate follower means engaging said swash plate for movement thereby in a direction crosswise of the boat and for angular oscillation relative to the swing frame about the follower axis, a drive member connected to the follower member for angular oscillation therewith, forward and reverse drive segments mounted for turning movement relative to each other and relative to the drive member about the follower axis, control means selectively operable to drivingly connect either the forward or the reverse drive segment to the drive member for angular oscillation therewith, forward drive means connecting the forward drive segment to the thrust blade for sinusoidally oscillating the thrust blade about the blade axis in a first phase relation to the angular oscillation of the drive member, and reverse drive means connecting the reverse drive segment with the thrust blade for sinusoidally oscillating the thrust blade about the blade axis in a second phase relation to the angular oscillation of drive member, which second phase relation is 180° out of phase with the first phase relation.

15. A boat propulsion apparatus according to claim 14 wherein said drive member is interposed between said forward and reverse drive segments, said control means including a dog clutch mounted on said drive member and selectively movable into driving engagement with said forward and said reverse drive segments.

16. A boat propulsion apparatus comprising a support structure, means for mounting the support structure on a boat, at least first and second swing frames mounted on the support structure for swinging movement about respective first and second generally horizontal swing axes adapted to extend generally lengthwise of the boat, at least one thrust blade mounted on each swing frame for swinging movement therewith about the respective swing axis and for turning movement relative to the respective swing frame about a generally upright blade axis, the thrust blades extending downwardly from the respective swing frame and each having thrust surfaces at opposite sides of a blade plane extending lengthwise of the blade axis medially between the thrust surfaces, rotary drive means for angularly oscillating the first and second swing frames about their swing axes 180° out of phase with each other to swing the thrust blades on the first and second swing frames in relatively opposite directions crosswise of the boat through a blade swing angle, said rotary drive means including means for angularly oscillating the thrust blade on each swing frame about their generally upright blade axis in timed relation with the angular oscillation of the swing frames to cyclically change the thrust angle of the blade between a zero thrust angle in which the blade plane is disposed parallel to the respective swing axis and a maximum thrust angle in which the blade plane is disposed at a preselected maximum angle to respective swing axis, said rotary drive means being operative to turn the blades about their respective blade axis while swinging the blades about the respective swing axis such that the blade plane of each blade is at the maximum thrust angle when the blades are at the center of their blade swing angle and at the zero thrust angle when the blades are at either extremity of their blade swing angle.

17. A boat propulsion apparatus according to claim 16 wherein said drive means includes a first direction control means for selectively reversing the direction of angular oscillation of the thrust blade on the first swing frame relative to the direction of angular oscillation of the first swing frame and a second direction control means for selectively reversing the direction of angular oscillation of the thrust blade on the second swing frame relative to direction of angular oscillation of the second swing frame.

18. A boat propulsion apparatus according to claim 16 wherein said drive means includes a first thrust control means for selectively varying the amplitude of oscillation of the first swing frame and the amplitude of angular oscillation of the associated thrust blade, and a second thrust control means for selectively varying the amplitude of oscillation of the second swing frame and the amplitude of angular oscillation of the associated thrust blade.

19. A boat propulsion apparatus comprising, a support structure, means for mounting the support structure on a boat, at least first and second swing frames mounted on the support structure for swinging movement about respective first and second swing axes adapted to extend lengthwise of the boat, at least one thrust blade mounted on each swing frame for swinging movement therewith about the respective swing axis and for turning movement relative to the respective swing frame about a generally upright blade axis, the thrust blades extending downwardly from the respective swing frame and having thrust surfaces at opposite sides, drive means for angularly oscillating the first and second swing frames about their swing axes 180° out of phase with each other to swing the thrust blades on the first and second swing frames in relatively opposite directions crosswise of the boat, said drive means including means for angularly oscillating the thrust blade on each swing frame about their generally upright blade axis in timed relation with the angular oscillation of the swing frames, said first and second swing frames being laterally spaced apart, said drive means including a drive shaft mounted on the support structure for rotation about a generally horizontal axis, first and second swash plates connected to the drive shaft for rotation thereby, first and second swash plate follower means respectively mounted on the first and second swing frames for turning about a follower axis generally radially the axis of the drive shaft, said first and second swash plate follower means engaging the respective first and second swash plates for movement thereby in a direction crosswise of the boat and for angular oscillation relative to the respective swing frame about its follower axis, and first and second means respectively connecting the first and second swash plate follower means to the thrust blade on the respective first and second swing frame for angularly oscillating the thrust blades in response to angular associated follower means.

20. A boat propulsion apparatus according to claim 19 wherein said first and second means each include direction reversing means for reversing the direction of angular oscillation of each blade in relation to the direction of angular oscillation of the associated follower means.

21. A boat propulsion apparatus according to claim 19 wherein said drive means includes first and second thrust control means for varying the angle of the respective first and second swash plate relative to the axis of the drive shaft.

* * * * *